United States Patent [19]

Vittoz

[11] 4,020,628

[45] May 3, 1977

[54] AUTOMATIC REGULATION OF AN ELECTRONIC WATCH

[75] Inventor: Eric A. Vittoz, Cernier, Switzerland

[73] Assignee: Centre Electronique Horloger S.A., Switzerland

[22] Filed: Sept. 29, 1975

[21] Appl. No.: 617,654

[30] Foreign Application Priority Data

Oct. 14, 1974 Switzerland ..... 13779/74

[52] U.S. Cl. ..... 58/145 K; 58/26 R; 58/35 W; 58/85.5; 179/2 TC

[51] Int. Cl.[2] ..... G04B 27/00; G04C 3/00

[58] Field of Search ..... 58/23 R, 24 R, 25, 26 R, 58/35 W, 50 R, 145 K, 152 T, 85.5; 179/2 E, 2 TC

[56] References Cited

UNITED STATES PATENTS

| | | | |
|---|---|---|---|
| 2,816,166 | 12/1957 | Benesch et al. | 179/2 TC |
| 3,777,065 | 12/1973 | Galian et al. | 179/2 TC X |
| 3,811,265 | 5/1974 | Cater | 58/24 R |
| 3,943,288 | 3/1976 | Reed et al. | 179/2 TC |
| 3,948,036 | 4/1976 | Morokawa | 58/23 R |

*Primary Examiner*—Stanley J. Witkowski
*Attorney, Agent, or Firm*—Stevens, Davis, Miller & Mosher

[57] ABSTRACT

An autonomous electric watch comprises a receiver for picking up a magnetic or acoustic coded regulation signal delivered by a telephone set, and a control circuit automatically controlling memory circuits of the watch to regulate the frequency and/or set the time displayed in response to reception of such a signal. The regulation signal is provided by a signal generator connected to an automatic telephone reply apparatus that can be called from any subscriber telephone set, and may be combined with a pre-recorded spoken message giving instructions to the caller.

9 Claims, 21 Drawing Figures

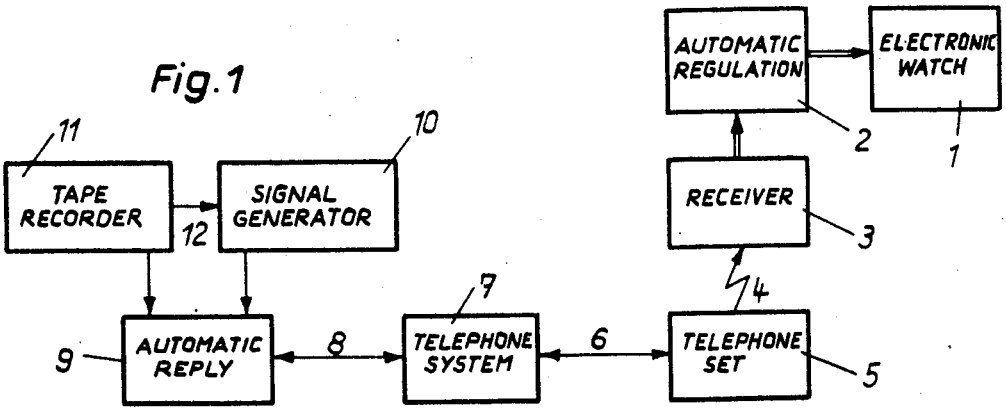
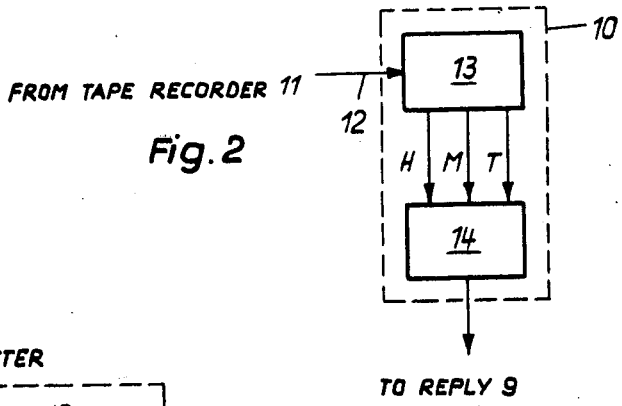
Fig.2
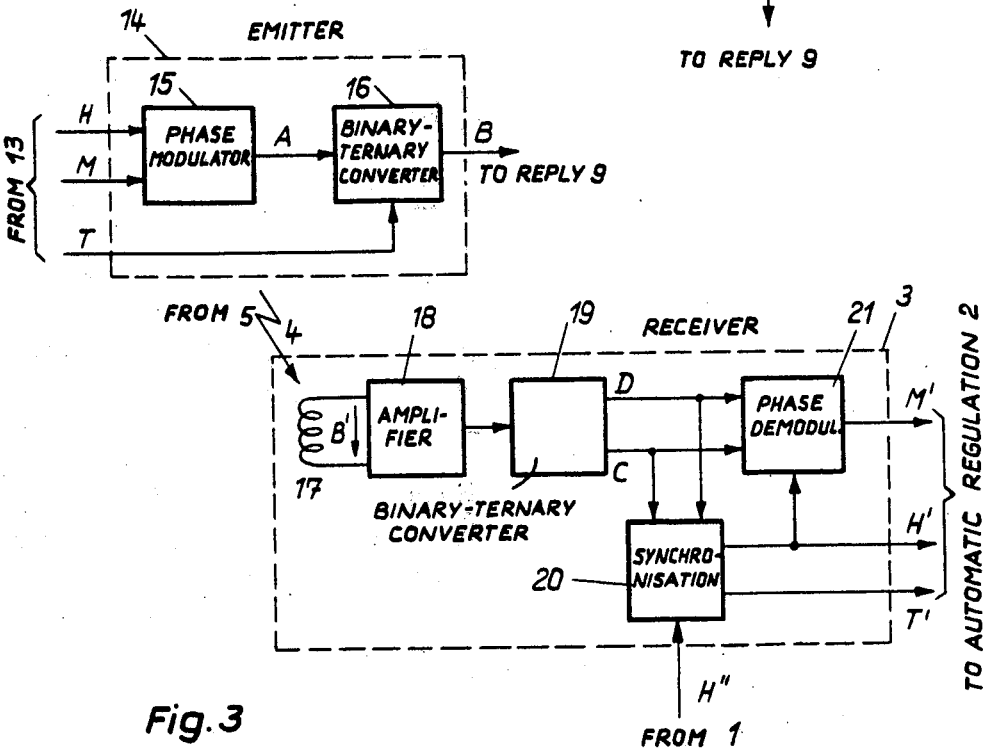
Fig.3

AUTOMATIC REGULATION OF AN ELECTRONIC WATCH

The invention relates to timepieces and the regulation or setting thereof.

Timepieces can be divided into two categories which to date have been distinct from one another. A first class comprises primary timepieces which have an autonomous time-base. To date this class includes al wrist-watches and the most widely sold alarm and other clocks.

A second class comprises mains-driven synchronized clocks, clocks receiving a radio or TV signal and secondary clocks controlled by master clocks in time-distributing systems.

A timepiece of the first class comprises an oscillator whose frequency must be as precise as possible. In mechanical watches, many operations must be carried out on te balance and the balance spring to poise it, adjust the period and ensure regular running. Analogous operations must be carried out on the resonator of an electronic watch. Even the resonator of a quartz watch, despite its very great intrinsic precision, requires elaborate and costly manufacturing operations to guarantee a precise frequency independent of the temperature.

The reason for seeking a osciallator with as precise a frequency as possible is that a constant frequency deviation produces an error in the time displayed which increases linearly as time-passes. Moreover, a frequency drift produces a uncertainty in the time displayed which increases as time passes. It is thus frequently necessary to set a watch to the correct time to avoid the cumulative effects of an imperfect oscillator.

The correct operation of a timepiece in general and a wrist-watch in particular involves regulations of two different types, carried out more or less frequently:

- Regulation of running of the watch which is a frequency regulation. This is carried out on a mechanical watch by displacing the regulator acting on the length of the balance spring.
- Setting the time of the watch, which is a phase regulation. This is carried out in a mechanical watch by means of a mechanism for uncoupling and driving the hands in response to turning of the winding stem in a pulled-out position. A change of the time zone is a special case of time setting.

In the case of an electronic watch, several methods of regulating running are known:

- Adjustment of the frequency of oscillation by means of a variable capacitor.
- Adjustment of the division ratio by logic means (Swiss Patent 534,913) or analog means. U.S. Patent No. 3,540,207 describes a particular case employing the principle of inhibition.

The regulation signal may be stored in an electrically-alterable memory (Swiss Published Patent Application 15117/71), coresponding to U.S. Pat. No. 3,895,486.

The method of setting the time of a electronic watch depends upon the display system used. If the display is by means of a micromotor driving hands, time setting can be carried out in the same manner as for a mechanical watch, possibly with the addition of a system for blocking the high frequency pulses to permit a precise regulation.

If the display is electronic, a known time-setting system consists of using a press-button with several positions enabling separate acceleration of the minutes and tens of minutes and to provide a stopping of the seconds (U.S. Pat. No. 3,576,099; Swiss Pat. No. 510,911; W. German Published Application DOS No. 2,025,710).

The manual input of time-setting data by means of a small number of input members can be carried out by means of a sequentially-acting system which attributes several different significations to the data introduced according to the state of the display at the moment of actuation (Swiss Pat. No. 533,332).

This latter method can be applied to regulation of the running of a watch by storing the regulating data in an electrically-alterable memory (Swiss Published Patent Application No. 15117/71, corresponding to U.S. Pat. No. 3,895,486.

The above-mentioned regulating processes have the common feature that they all require a human intervention. The operator begins by measuring running or observing the time displayed over a relatively long period, then he determines the correction to be made and finally manually acts on an ad hoc member (regulator, capacitor, set of contacts) to correct the variation in running.

The second class of timekeepers mentioned at the outset is that of synchronized timekeepers (receiving clocks). For the time being, this class does not inclde wrist-watches. There are several reasons for this. A first is the difficulty in miniaturizing certain members of such a system, in particular the antenna. A second is the uncertainty in the conditions for receiving the synchronizing signal when the wearer moves around, travels in automobiles, is located in a building of which the metallic armature acts as a shield, or to the contrary is in a location far removed from civilization. A third reason is the necessity of having a sufficiently dense network of powerful emitters covering a large area to provide synchronization of the watch when its wearer travels over great distances.

The system described in Swiss Published Patent Application No. 15118/71 (corresponding to U.S. Pat. No. 3,914,706) enables automatic regulation of the running of a watch by simple application of a signal defining a reference period. This system includes an autonomous time base but is akin to the second class of timekeepers in that the regulation takes place by means of an unilateral flux of data, i.e. it is no longer necessary to observe running of the watch before carrying out regulation. However, even with this known type of watch, frequency regulation is basically conceived as a factory operation before sale. If regulation becomes necessary later, not only would it be necessary to open the watch, but unless the watch repairer is specially equipped with regulation apparatus to provide the reference signal, the watch must be sent back to the factory.

An object of the invention is to even better combine the advantages of the two stated classes of timepieces by providing for the regulation of a autonomous electronic watch automatically by means of external signals that the user can receive by a simple telephone call without himself having to carry out any operation inside the watch.

The invention therefore concerns a process for the automatic regulation of an electronic watch of the type comprising a time base, memory circuits and display means, as well as an automatically-adjustable electronic watch of the mentioned type.

The process according to the invention is characterized in that it comprises composing on a telephone set in a telephone system the call code of an automatic telephone reply apparatus arranged to supply data necessary for the regulation at any time of the timepiece, and placing the timepiece so that the coded signals transmitted by the reply apparatus control the state of the memory circuits of the timepiece to automatically set the latter.

The electronic watch according to the invention is characterized in that it comprises a receiver for the coded signals emitted by the automatic reply apparatus and transmitted by the telephone set, connected to automatic regulation means for controlling the state of the memory circuits as a function of said signals so as to provide setting.

These and further objects and features of the invention will now be described in detail with reference to the accompanying drawings, in which:

FIG. 1 is a block-diagram of an electronic watch and a system for regulating the watch;

FIG. 2 shows a signal generator for the system of FIG. 1;

FIG. 3 is a block diagram of an emitter circuit and a receiver circuit of the FIG. 1 system, adapted for a magnetic coupling;

Figure 4:
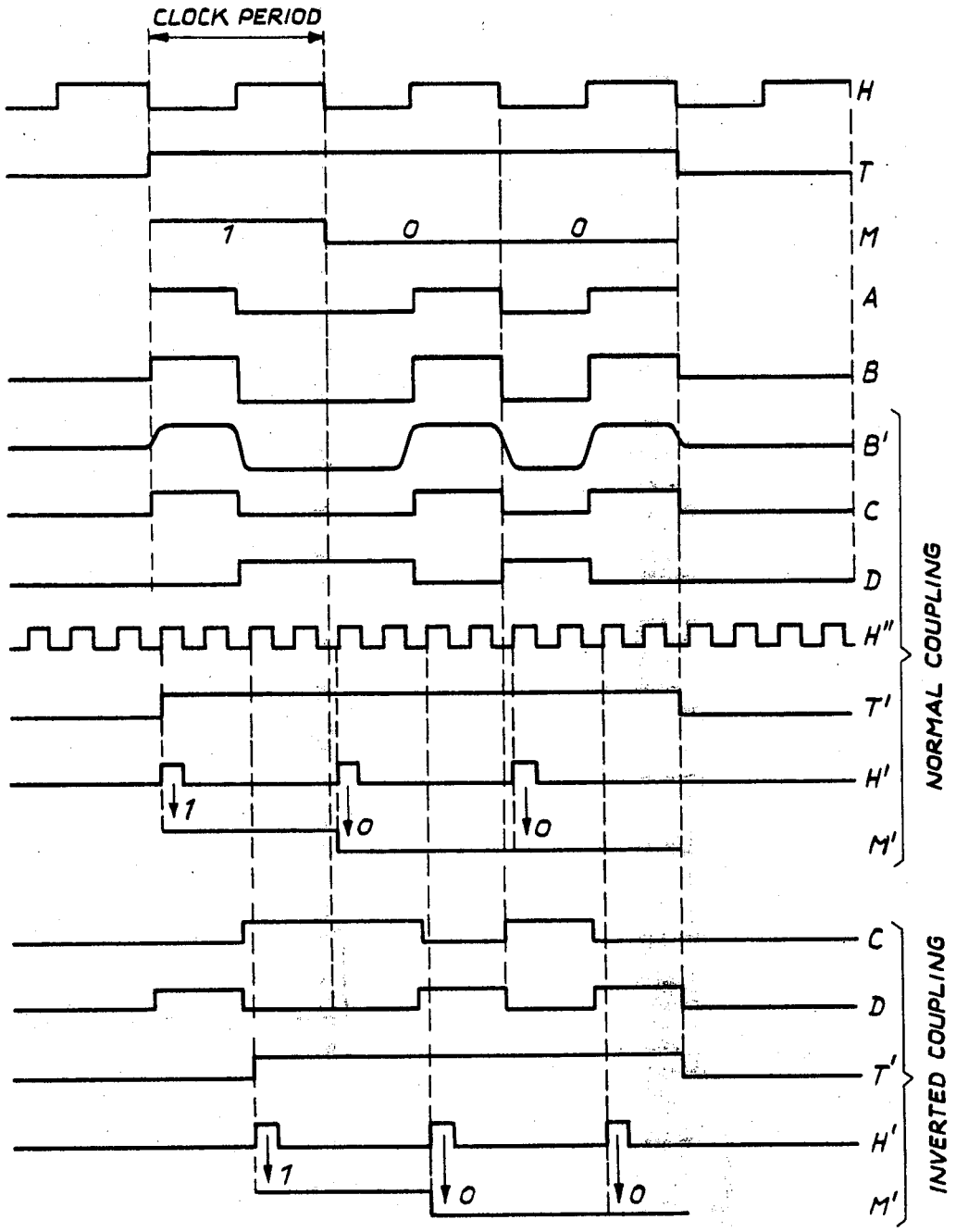
FIG. 4 is a diagram of the signals of the emitter and receiver of FIG. 3.

FIG. 1 shows an electronic watch and a regulating system for the watch. To receive the information necessary for its regulation, the electronic watch must have input means corresponding to the frequency setting and time setting. These input means will be explained further on, together with frequency-setting and time-setting circuits of the regulating system.

To an electronic watch 1 are connected an automatic regulation circuit 2 and a receiver 3 incorporated in the case of watch 1. The receiver 3 can receive signals 4 emitted by a conventional telephone handset 5 located on the premises of any subscriber and connected in a telephone system 7 by a line 6. On the premises of a specific subscriber connected to the same telephone system 7 by a line 8 is an automatic replying apparatus 9 connected to a signal generator 10 and a tape recorder 11. The tape recorder 11 can supply synchronization pulses to the generator 10 by a connection 12.

This system permits the person having the electronic watch to regulate if from any telephone set according to the following process:

In the normal manner of operation of a telephone system, the person having watch 1 calls the special subscriber corresponding to line 8 by composing the appropriate number or call code on the telephone set 5. The reply apparatus 9 automatically replies to this call by transmitting a spoken message previously-recorded on tape recorder 11. This spoken message indicates what operations must be carried out to provide a direct coupling between the receiver 3 and set 5. After this message, a pulse in supplied to the signal generator 10 by connection 12. Generator 10, triggered by this pulse, supplies to the reply apparatus 9 a coded logic message containing information on the time and/or the reference frequency necessary for regulation of the watch. This message is received by the telephone set 5 and transmitted to the regulation circuit 2 by the signal 4 acting on receiver 3. The circuit 2 automatically carries out setting of the watch 1 according to the information contained in the meassage.

It is evident that the electronic watch to be regulated wth the system of FIG. 1 must be specially adapted to be able to receive the information from the regulating system. For regulation of the running or frequency setting, the electronic watch will be one whose frequency can be set be receiving a signal reference or standard signal of a given period. Such a watch 1 (excluding the receiver 3 and automatic regulation circuit 2 which will be described later) is described in detail in Swiss published Patent Application 15118/71, corresponding to U.S. Pat. No. 3,914,706. In the case of setting the time, the arrangement of the watch enabling the time-setting signals to be received and to effect correction will be explained further on.

After the end of the coded message, a second spoken message, pre-recorded in tape recorder 11, indicates to the user that regulation of the watch has been completed.

In a variation, the units 9, 10, 11 of the described system may, instead of being located on the premises of a subscriber, be located in a telephone exchange of the system. It would thus continuously operate in the manner of the so-called "speaking clock", and the message transmitted could be simultaneously received by any number of subscribers.

The elements 1, 5, 6, 7, 8, 9, and 11 of the system are all well known and will not be described in detail.

To the contrary, examples of the receiver 3 and the regulating device 2 will be described for the two types of transmission signal envisaged, namely an acoustic signal and a magnetic signal supplied by the leakage flux of the transformer or of the earpiece of telephone set 5.

An example of a signal generator 10 for each of the two types of signals wil also be described. The signal generator 10 can be decomposed into two units 13 and 14 shown in FIG. 2.

Unit 13, triggered by a pulse from the tape recorder 11 and delivered by connectin 12, generates three logic signals formed of 0 or 1 : a clock signal H, a signal M forming the message comprising all of the data necessary to set the time of watch 1 and/or its frequency, and possibly further complementary data, and a third signal T indicating that a message is being transmitted. Unit 14 acts as an emitter and converts this data into a signal compatible with the telephone system and with the type of acoustic or magnetic signal 4 used to couple set 5 and receiver 3. From the picked-up signal 4 the receiver 3 provides thre logic signals H', M' and T' containing the same data as signals H, M and T and transmits these signals to the regulation device 2. Only the emitter 14 and receiver 3 depend on the type of signal 4 used for the coupling. Examples of these two units for the two types of coupling envisaged will now be described.

FIG. 3 shows an example of an emitter 14 and a receiver 3 compatible with coupling by a signal 4 in the form of a magnetic field. The corresponding signals are shown on FIG. 4.

The emitter 14 comprises a phase modulator 15 and a binary-ternary converter 16. Phase modulator 15, controlled by clock signal H and message signal M, supplies at its output a signal A. The binary-ternary converter 16, cntrolled by this signal A and signal T indicating that a message is being emitted, supplies at its output a signal B to the automatic reply apparatus 9.

The receiver 3 comprises a pick-up coil 17 capable of picking-up the stray or leakage magnetic field of the transformer generally incorporated in the telephone set 5 or, in the absence of this, the leakage flux of the telephone set earpiece.

The signal B' picked up by coil 17 is amplified by an amplifier 18 and delivered to a ternary-binary converter 19 supplying logic signals C and D.

A synchronization unit 20 generates clock signal H' and signal T' from signals C, D and from an auxiliary clock signal H'' supplied by electronic watch 1. A phase demodulator 21 regenerates message M' from C, D and H'.

Operation of the emitter-receiver combinatin 14-3 is as follows (see FIG. 4 showing the signals):

Message M is formed of a sequence of logic states 1 and 0 each corresponding to one period of clock signal H, and is significative only when variable T is at 1. In the example, message M is formed of the sequence 1 0 0. The phase modulator 15 transforms signal M into a signal A such that when M is at 1, A is at 1 during the first half of the clock period and at 0 during the second half; conversely, when M is at O, A is at 0 during the first half of the period, and at 1 during the second half.

The binary-ternary converter 16 transforms signal A into a signal B which is positive when A is at 1, negative when A is at 0, and zero in the absence of a message (T = 0). The means value of signal B is always zero, whatever be the content of message M. Signal B can thus always be transmitted, without alteration of the message it contains, through the telephone system which does not restitute D.C. components.

The signal B' picked up by coil 17 has sustantially the same shape as B. The building-up or transition times are limited by the upper cut-off frequency of the telephone system. Signal B' is amplifed by amplifier 18 up to a sufficient level for control of the ternary-binary converter 19. The latter supplies two logic signals C and D. C is at 1 only when B' is positive; D is at 1 only when B' is negative; C and D are thus simultaneously at 0 only if no message is transmitted (B' zero).

While it is relatively easy to have in the watch a clock signal having substantially the same frequency as the standard clock signal H, it is necessary to provide a synchronizing device to ensure synchronization of their phases. In this example, the watch 1 delivers to synchronization unit 20 a signal H'' whose frequency is four times H. Unit 20 produces synchronization signal H' by allowing passage of one pulse H'' in four, starting with the first pulse appearing after the first passage of signal C to value 1.

Unit 20 also restitutes signal T' indicating that a message is being transmitted. T' passes to 1 upon the first pulse of H' and returns to 0 as soon as C and D are both zero. Signal H' enables demodulator 21 to restitute message M' by sampling the value of C during the pulses of synchronization signal H'.

It may be observed that message M' is only satisfactorily restituted if the first bit of M is a 1; if the first bit of M is a 0, the reconstituted message M' will be inverted (0 instead of 1, and vice versa). This is not a major drawback, as it is easy to arrange for each message to begin by a 1.

This first bit may be considered as a sign bit, since it permits reconstitution of the message by the device even if the direction of signal B' picked up by coil 17 is inverted, as illustrated by the form of signals at the bottom of FIG. 4.

If in fact B' is inverted, C and D are permuted and the first clock pulse H' is delayed by a half-period. The message M' obtained by sampling C is however correctly restituted.

Figure 5:
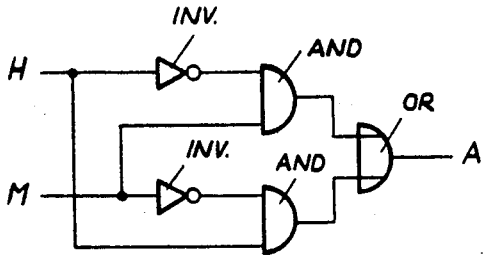
FIG. 5 shows an example of a phase modulator.

FIG. 5 shows the circuit of a phase modulator 15 of the emitter of FIG. 3, with two inverters, two AND gates and an OR gate connected as shown to carry out the function $A = \overline{H}M + H\overline{M}$ which signifies that A is equal to H when M is at 0, and to the reciprocal of H when M is at 1.

Figure 6:
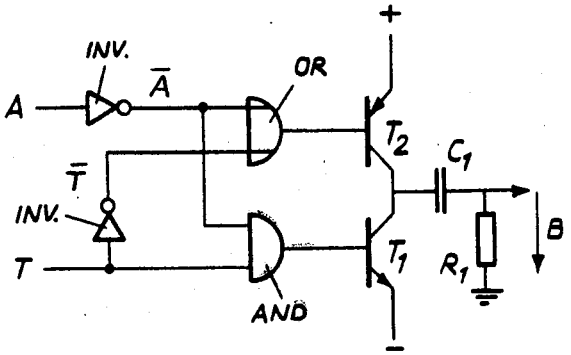
FIG. 6 shows an example of a binary-ternary converter.

FIG. 6 shows the circuit of a binary-ternary converter 16 of FIG. 3, comprising a pair of complementary transistors $T_1$ and $T_2$ in series between positive and negative poles of the supply. The base of NPN transistor $T_1$ is controlled by the output of an AND gate whose two inputs are connected to the reciprocal $\overline{A}$ of A and to T. The base of PNP transistor $T_2$ is controlled by an OR gate whose inputs are connected to the reciprocal $\overline{A}$ of A and the reciprocal $\overline{T}$ of T. The signal B is taken from the collectors of $T_1$ and $T_2$ through a coupling capacitor $C_1$. When $T=0$, the two transistors are blocked and the output B is at 0. If $T = 1$ and $A = 1$, $T_1$ is blocked but $T_2$ conducts and brings B to a positive level. If $T = 1$ and $A = 0$, $T_2$ is blocked but $T_1$ conducts and brings B to a negative level.

The pick-up coil 17 is fixedly incorporated in the watch in the form of a simple coil having dimensions and number of turns selected to be able to provide a sufficient signal.

Figure 20:
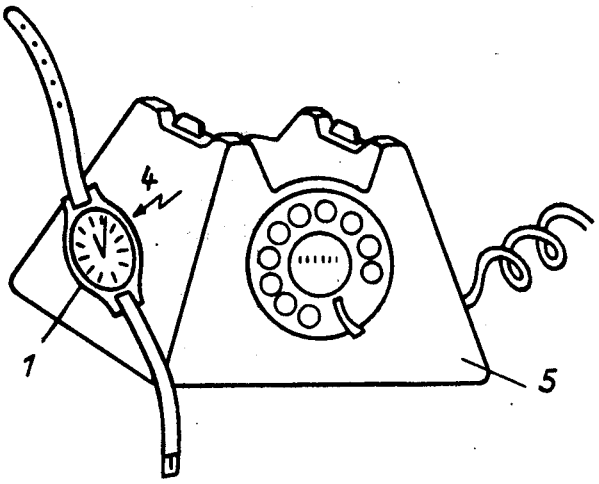
FIG. 20 shows how the watch should be placed relative to a telephone set in the case of a magnetic coupling by leakage flux of the transformer.

To provide a good coupling during the regulation operation, the watch should be placed in the immediate neighborhood of the main body of the telephone set 5, as indicated in FIG. 20.

Experience has shown that the coupling is not greatly reduced when the watch has a metal case. The amplitude of the signal pickup up by such a device is comprised between several tens of a microvolt and several tens of a millivolt, according to the dimensions of the coil and its number of windings.

Figure 7:
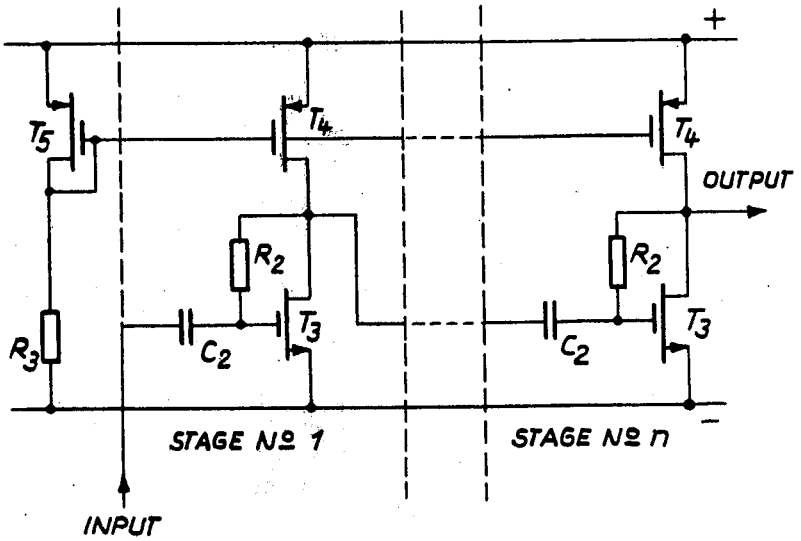
FIG. 7 shows an example of an amplifier.

FIG. 7 shows a circuit of amplifier 18 of FIG. 3 compatible with the CMOS technology which is tending to become generally applied in electronic watches.

Amplifier 18 is formed of n stages in cascade, each stage comprising an n-channel transistor $T_3$ which is polarized in operation by means of a p-channel transistor $T_4$ (forming a current source) and a resistor $R_2$. Connection with the preceding stage is provided by a capacitor $C_2$. An auxiliary circuit formed of a p-channel transistor $T_5$ and a resistor $R_3$ supplies the grid voltage common to all of transistors $T_4$.

Figure 8:
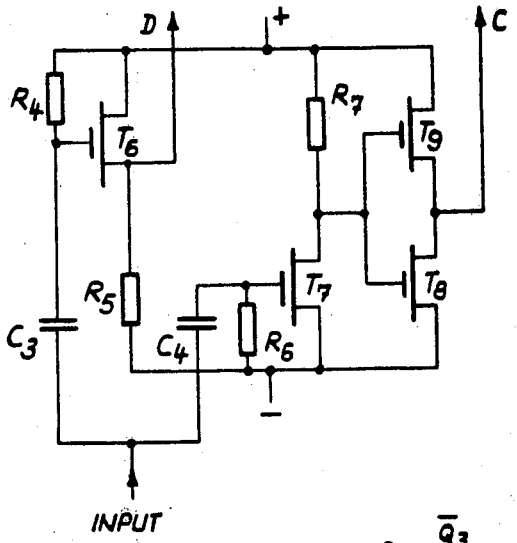
FIG. 8 shows an example of a ternary-binary converter.

FIG. 8 shows a circuit of the ternary-binary converter 19 of FIG. 3, which is also compatible with CMOS technology. In the absence of a input signal, transistors $T_6$ and $T_7$ are blocked by the presence of respective resistors $R_4$ and $R_6$. The output D is thus held at negative potential (logic 0) by ballast resistor $R_5$. The drain of $T_7$ is held positive (logic 1) by ballast resistor $R_7$. The output C of inverter $T_8$–$T_9$ is thus also at 0. During the positive phases of the input signal, $T_6$ remains blocked but $t_7$ conducts, and hence output C is at 1 and output D at 0. During negative phases, $T_6$ conducts and $T_7$ is blocked, bringing output D to 1 and C to 0.

Figure 9:
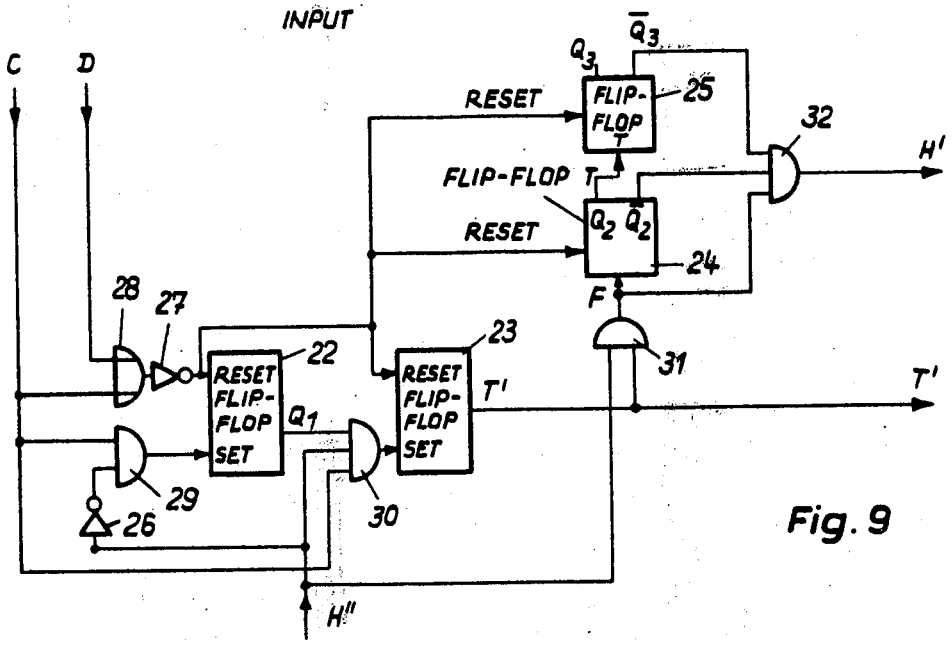
FIG. 9 shows an example of a synchronization circuit.

FIG. 9 is a logigram of an example of the synchronization unit 20 of FIG. 3. This unit is composed of two RS flip-flops 22 and 23, two T flip-flops 24 and 25, two inverters 26 and 27, an OR gates 28 and four AND gates 29, 30, 31 and 32, connected as shown.

In the absence of a message, the two input qunantites C and D are at 0. The four flip-flops 22 to 25 are thus set to zero. Hence, $Q_1 = 0$ and $T' = 0$, indicating the absence of a message. This state is held as long as C remains at O. When C passes to 1, the output of gate 29 follows variations of the reciprocal $\overline{H''}$ of $H''$. The output $Q_1$ of RS flip-flop 22 thus passes to 1 the first time that $H''$ is at 0, i.e. with a delay of about half a period of $H''$ in relation to C. The output of gate 30 will then pass to 1 upon the first transition of $H''$ from 0 to 1, bringing the output $T'$ of RS flip-flop 23 to 1. $T'$ thus passes to 1 with a delay of less than a half a period of $H''$ in relation to C. $T'$ and $Q_1$ then remain at 1 as long as C or D is at 1, and return to 0 as soon as C and D are once or simultaneously at 0 (absence of a message). The signal $T'$ obtained consequently has the desired shape shown in FIG. 4. The remainder of the circuit of FIG. 9 permits generation of clock signal $H'$. While $T'$ is at 1, the gate 31 allows passage of a train of pulses F which follow variations in the auxiliary clock signal $H''$. These pulses control the two T filp-flops 24 and 25 (dividers by 2) which supply signals $Q_2$ and $Q_3$ as well as their reciprocals $\overline{Q_2}$ and $\overline{Q_3}$. The AND gate 32 is controlled by F, $\overline{Q_2}$ and $\overline{Q_3}$; its output is 1 only when $Q_2$ and $Q_3$ are at 0 and F is at 1, which corresponds to the desired shape of $H'$.

Figure 10:
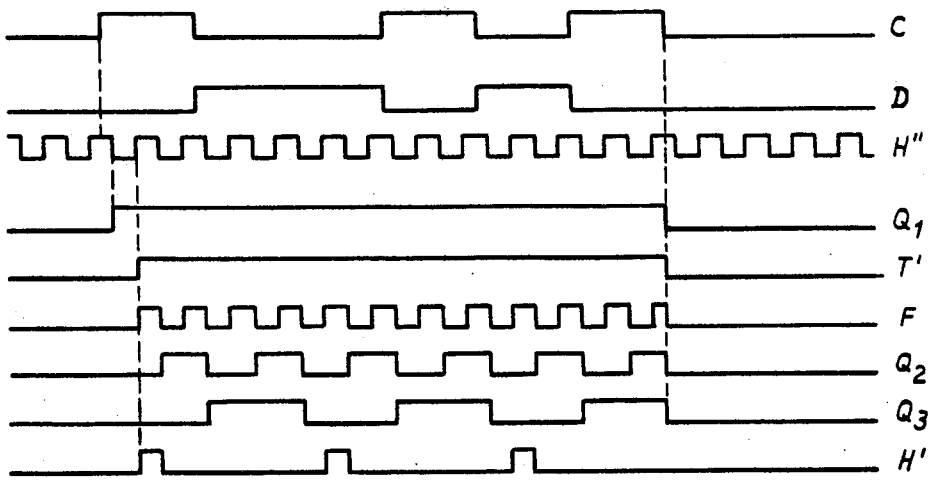
FIG. 10 is a diagram of the signals of the circuit of FIG. 9.

It should be noted that when C and D are simultaneously at 0 (absence of a message), $O_1$, $T'$, F, $Q_2$ and $Q_3$ are all at 0. FIG. 10 shows a diagram of the signals obtained in the circuit of FIG. 9, in the case were C passes to 1 while $H''$ is at 1. If $H''$ were at 0 at this moment, the only difference would be that $Q_1$ would immediately pass to 1.

Figure 11:
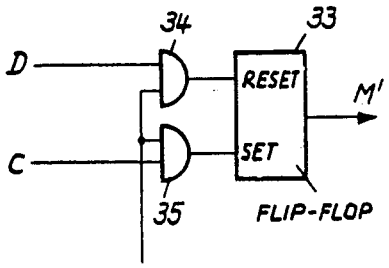
FIG. 11 shows an example of a demodulator.

FIG. 11 shows the logigram of an example of the phase demodulator 21, formed of an RS flip-flop 33 controlld by two AND gates 34 and 35. When a clock pulse $H'$ appears, $M'$ is set to 1 by the set input if $C = 1$ and $D = 0$, and $M'$ is set to 0 by the reset input if $C = 0$ and $D = 1$; $M'$ is unchanged if $C = D = 0$, i.e. if no message is transmitted.

The emitter-receiver combination described with reference to FIGS. 3 to 11 may be adapted to a mode with coupling by an acoustic signal 4. For this, it suffices to replace the pick-up coil 17 by a microphone which must be placed near the telephone set earpiece during the regulation operation.

The signal B transmitted in electric form to the telephone system by emitter 14 is transformed into an acoustic signal of similar form by the telephone earpiece. The microphone replacing pick-up coil 17 retransforms this acoustic signal into an electric signal $B'$.

This specific embodiment of the invention using an acoustic coupling has the disadvantage of requiring a telephone earpiece and a microphone each having a "flat" frequency response, i.e. without resonance. In effect, a resonance could be produced by a component of signal B which is unduly amplified. The signal $B'$ could be so distorted that any reconstitution of the message $M'$ becomes impossible.

Figure 12:
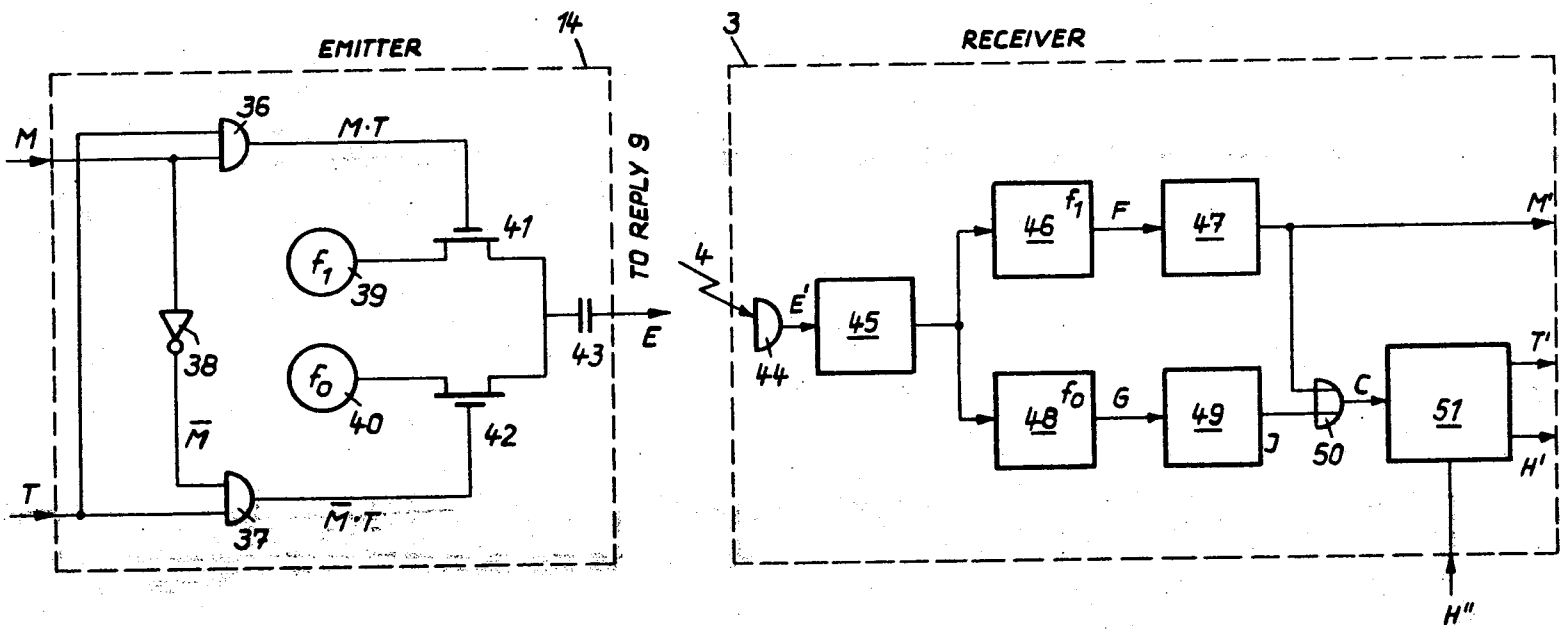
FIG. 12 is a block diagram of a emitter circuit and a receiver circuit adapted for an acoustic coupling.
Figure 13:
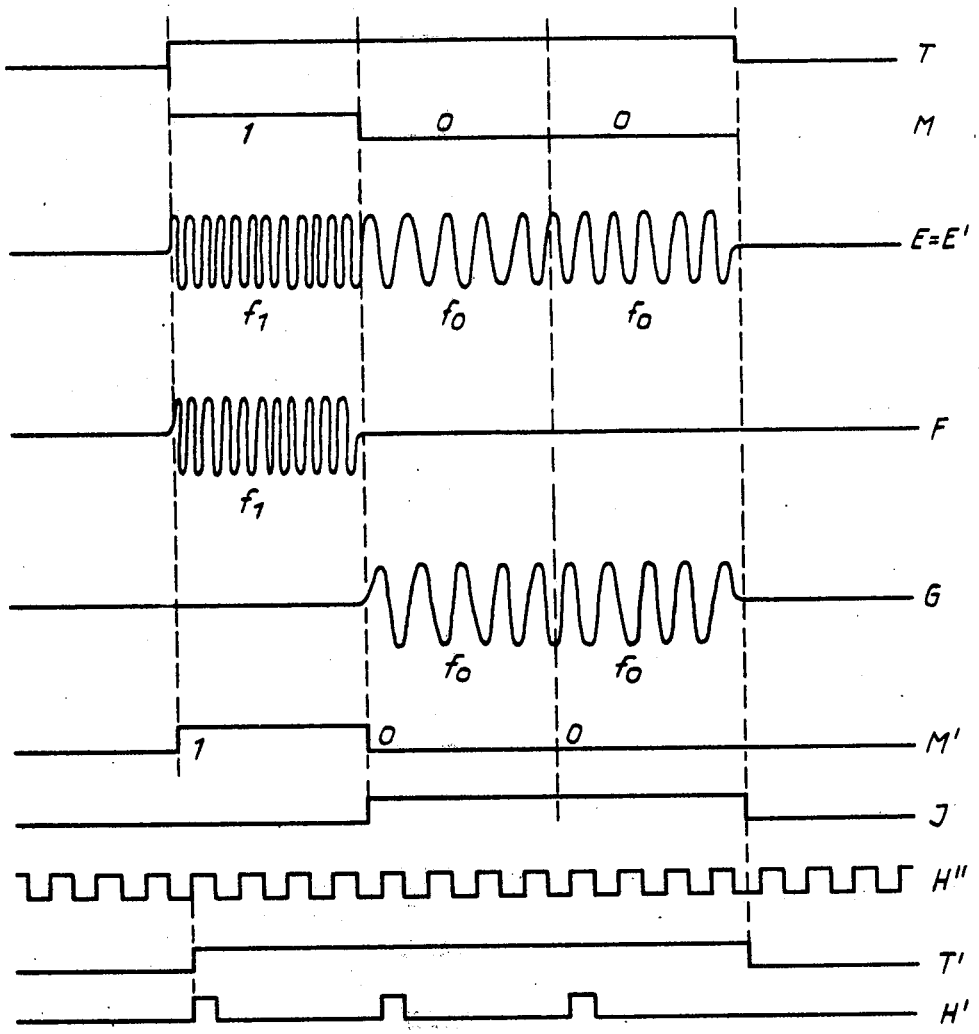
FIG. 13 is a diagram of the signals of the emitter and receiver of FIG. 12.

An example of an emitter 14 and receiver 3 which enables this drawback to be eliminated is shown in FIG. 12, and the shape of the various corresponding signals is shown in FIG. 13.

The emitter 14 is formed of two oscillators 39 and 40 respectively of frequency $f_1$ and $f_0$ connected to the output controlling reply device 9 via transistors 41 and 42 and a coupling capacitor 43. The transistors 41 and 42 are controlled by respective AND gates 36 and 37 themselves controlled respectively by signals M, T and $\overline{M}$, T, where the signal is derived from signal M applied to inverter 38.

The receiver 3 is formed by a microphone 44 connected to the input of an amplifier 45. The output of amplifier 45 is connected to the inputs of two filters 46 and 48 whose respective outputs supply detectors 47 and 49. The output of detector 47 supplies the reconstituted message $M'$ whereas the output J of 49 is combined with $M'$ in an OR gate 50 before controlling the synchronization unit 51 generating signal $T'$ and $H'$.

Operation of this emitter-receiver combinations is as follows (see FIG. 13):

The meassage M to be transmitted is formed of a sequence of values 1 and 0; the example shown is once more the simple sequence 1 0 0. Variable T is at 1 during the message ad 0 between messages. When T is at 0, neither of transistors 41 and 42 conducts, and the signal is zero. When T and M are at 1, transistor 41 conducts. The signal E thus has the frequency $f_1$ of oscillator 39. When $M = 0$ and $T = 1$, transistor 42 conducts, and signal E has the frequency $f_0$ of oscillator 40. The emitter 14 thus formed a frequency modulator supplying a signal E whose frequency passes from $f_1$ to $f_0$ when M passes from 1 to 0.

Figure 21:
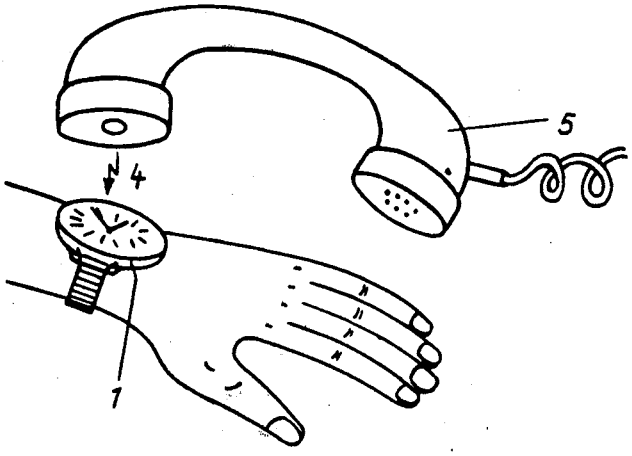
FIG. 21 shows how the watch is placed in front of a telephone earpiece in the case of an acoustic coupling.

During the regulation operation, the microphone 44 is placed in the proximity of the earpiece of telephone set 5 (see FIG. 21). The shape of the signal $E'$ it delivers is substantially identical to the original signal E. It is amplifed by 45 and then separated into its two components of frequency $f_1$ and $f_0$ by filters 46 and 48. An alternating signal F appears at the output of 46 only during the states 1 of message M whereas an alternating signal G appears at the output of 48 while M is at 0. The signals are rectified and shaped separately by detectors 47 and 49. The output of 47 represents the reconstituted message $M'$. the signal $C'$ formed by logic addition of $M'$ and J supplies to the synchronization unit 51 data on the presence of a message. Unit 51 is identical to unit 20 of FIG. 3 and operates in the same manner, except that input D is not used.

All of the constitutive elements of emitter 14 of FIG. 12 are known to persons skilled in the art and will not be described in detail.

The microphone 44 is fixedly incorporated in the watch. A special construction should be used, for example using the watch glass as membrane and coupling it mechnically to a piezoelectric transducer.

To ensure a good coupling during the regulating operation, the watch must be placed in front of the telephone earpiece as indicated in FIG. 21.

Amplifier 45 may be of the type shown in FIG. 7.

The band-pass filers 46 and 48 may be one of many types known to persons skilled in the art, preferably active filters compatible with integration techniques.

Figure 14:
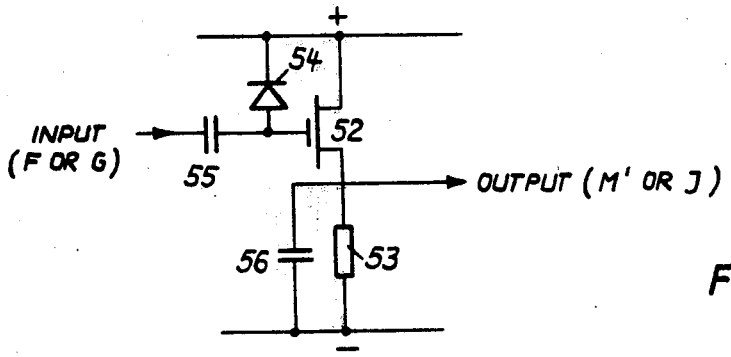
FIG. 14 shows an example of a detector of the receiver circuit of FIG. 13.

The detectors 47 and 49 may be provided in the form shown in FIG. 14, comprising a p-channel MOS transistor 52 with a ballast resistor 53 in parallel with a capacitor 56, a diode 54 connecting the grid to the source, and a coupling capacitor 55.

In the absence of an alternating signal at the input the transistor 52 is blocked by diode 54 and the output is at (logic 0). An alternating signal at the input is transmitted to the grid. The diode 54 prevents the grid potential from rising above the voltage +, so that the double amplitude of the alternating signal appears at the grid, causing the conduction of the transistor each period. The output rises to the voltage + (logic 1) and is maintained by means of capacitor 56 until disappearance of the alternating signal.

Up to now, the description has concerned the part of the device enabling reconstitution, upon reception, of the logic message M′ corresponding to the transmitted message M.

The above description contains the explanations required by persons skilled in the art concerning transmission of data for the regulation of a watch. No precise explanation has yet been given concerning this data (message M). It is evident that message M may include very complex data concerning notably setting of the frequency and setting of the time.

Examples will now be described of the circuits 13 and 2 of the system of FIGS. 1 and 2, namely circuit 13 for generating the message M as well as the auxiliary logic quantities H and T, and the circuit 2 for using the message M′ and the auxiliary quantites H′ and T′ to provide automatic regulation of running of the watch, or adjustment of the frequency. As stated above, frequency regulation can be carried out on a watch to which it suffices to supply a reference time in the form of a standard signal X held at state 1 exactly during the reference time. Such a watch having an input X to receive this standard signal is described in detail in Swiss Published Patent Application No. 15118/71, corresponding to U.S. pat. No. 3,914,706.

Figure 15:
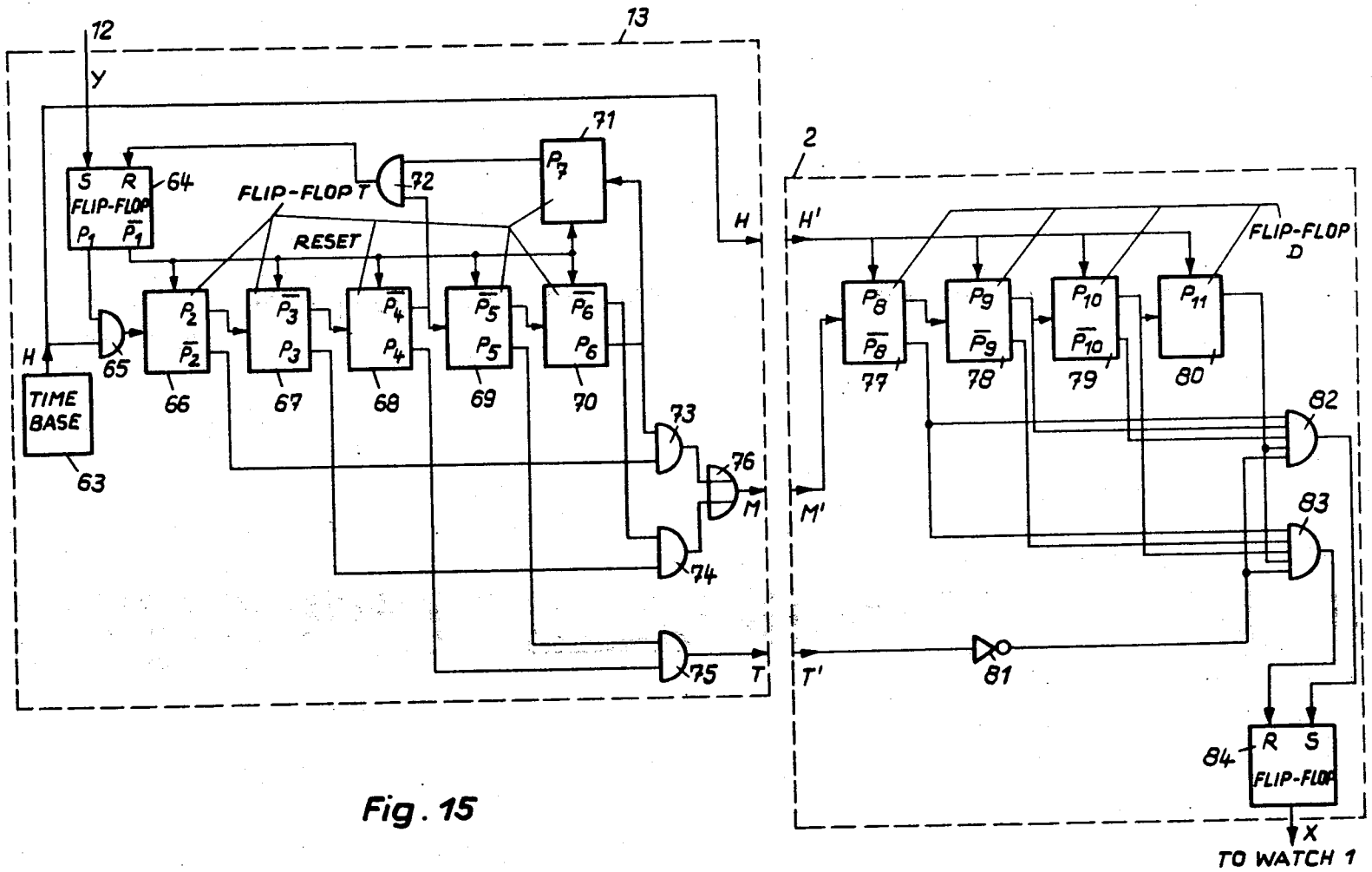
FIG. 15 shows an example of the signal generator and automatic regulating circuits of FIG. 1 permitting the automatic regulation of running, or frequency setting, of the watch.
Figure 16:
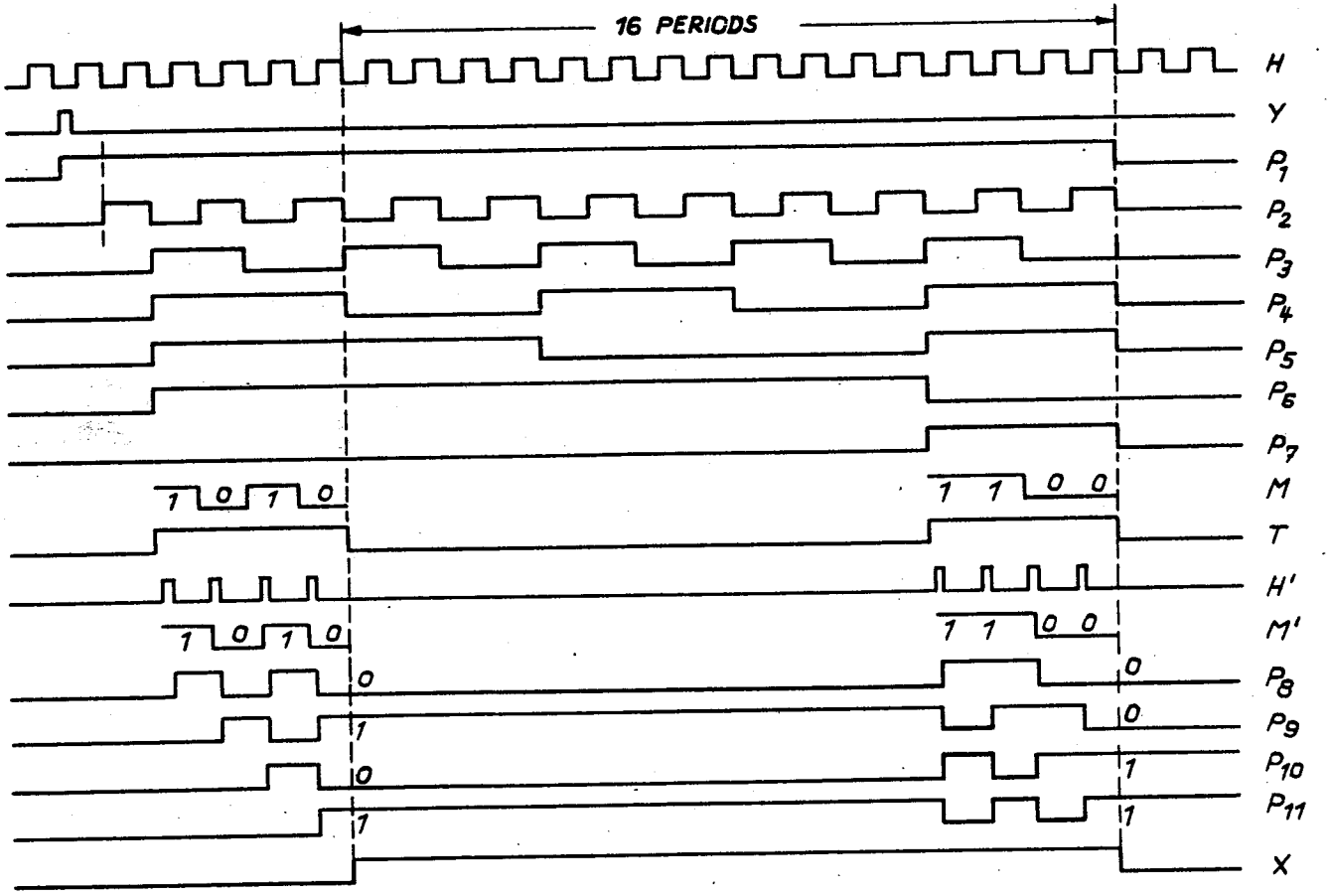
FIG. 16 is a diagram of the signals of the circuits of FIG. 15.

FIG. 15 shows the diagram of units 13 and 2 enabling such a standard signal to be supplied to a watch. FIG. 16 shows the shape of the various corresponding signals for the circuits of FIG. 15.

The generator unit 13 comprises a time base 63 supplying a clock signal H of well determined frequency. This time base 63 supplies a counter formed of T flip-flops 66 to 71 via an AND gate 65. The other input of gate 65 is controlled by the output $P_1$ of RS flip-flop 64. The set input S of 64 is connected by 12 to tape recorder 11, whereas its reset input R is connected to the output of AND gate 72 controlled by output $P_7$ of 71 and output $\overline{P}_4$ of 68. The output $\overline{P}_1$ 64 is connected to the reset inputs of flip-flops 66 to 71. The outputs of T flip-flops 66 to 70 are combined in a logic circuit formed of AND gates 73, 74 and 75 and OR gate 76 to form signals M and T which are transmitted to the emitter 14 in addition to clock signal H.

The control unit (regulation citcuit ) 2 is supplied by signals M′, T′ and H′ supplied by receiver 3. It comprises a shift register formed of four D flip-flops 77 to 80 using H′ as clock signal. The input of this register is supplied by M′. Outputs $P_9$, $P_{10}$ and $P_{11}$ of the flip-flops, the reciprocals $\overline{P}_8$, $\overline{P}_9$, $\overline{P}_{10}$ and the reciprocal $\overline{T}'$ of T′ obtained at the output of inverter 81 are combined in AND gates 82 and 83 to form set and reset signals S and R of an RS flip-flop 84 whose output delivers the signal X to be supplied to watch 1.

Operation will be described by means of an example in which the period of clock signal H is exactly 1/16 the reference signal to be supplied to the watch.

The signals obtained are shown in FIG. 16.

In the absence of a signal Y on input 12, the output $P_1$ of 64 is 0; gate 65 is closed and signal H does not reach counter 66 to 71 which is maintained at 0 by $\overline{P}_1$.

A synchronization pulse Y supplied by the tape recorder makes $P_1$ pass to 1, which opens gate 65 and triggers counter 66 to 71 supplying signals $P_2$ to $P_7$ shown in FIG. 16. When the counter reaches the state for which $P_7 = 1$ and $P_4 = 0$, the output of AND gate 72 passes to 1 and sets flip-flop 64 to 0. Gate 65 is once mor closed and the counter set to 0 until the following cycle is triggered by a new pulse Y.

During this cycle two successive message are delivered to emitter 14, as indicated by variable T which passes to 1 when $P_4$ and $P_5$ are simultaneously at 1. The signal M passes to 1 when $P_6 = 1$ and $P_2 = 0$ or when $P_6 = 0$ and $P_3 = 1$. The value of M is only of interest during the time of the messages ($T = 1$); at other times it is of no interest. An examination of FIG. 16 shows that the first message is formed of the succession 1 0 1 0 whereas the second message is formed of the succession 1 1 0 0. These two messages are used by unit 2 to distinguish the beginning and the end of the reference time.

The signals M′ and T′ received by unit 2 are substantially identical to the transmitted signals M and T.

The signal H′ has a frequency very close to that of H but is present only when a message is transmitted; it thus comprises in this example four pulses per message, each of these pulses causing an advance of one cell in the shift register 77 to 80. After the four pulses H′ of the first message, the states of outputs $P_{11}$, $P_{10}$, $P_9$ and $P_8$ correspond respectively to the successive states 1, 0, 1, and 0 of variable M. When T′ drops to 0, all of the inputs of AND gate 82 are at 1, hence its output passes to 1, causing X to pass to 1.

After the four pulses H′ of the second message, the states of outputs $P_{11}$, $P_{10}$, $P_9$ and $P_8$ correspond respectively to the successive states 1, 1, 0 and 0 of M. When T′ passes to 0, all of the inputs of AND gate 83 are at 1, hence its output passes to 1, causing X return to 0.

The variable X thus remains at 1 during exactly sixteen periods of clock signal H. Hence, a reference signal derived from the clock signal H is supplied to watch 1.

The content of the two messages, forming the codes indicating the beginning and the end of the reference time can of course be different to those given in the example. For this purpose, it suffices to modify the combinational logic circuits formed in this example by gates 74 to 76 and 82, 83. It is also possible to modify the number of bits of each message and/or the reference time by lengthening or reducing the counting chain 66 to 70 and the shift register 77 to 80. A mor complicated code increases the complexity of the circuits, but provides a greater immunity of the watch-regulating system to possible interference. The reference time used must be short enough to ensure that regulation does not take up too much time. It must also be long enough to ensure a sufficient regulating precision, taking into account the most rapid transition that can be transmitted by the telephone system.

EXAMPLE

The upper cut-off frequency of the telephone system is about 3K Hz. If the emitter-receiver arrangement of FIG. 3 is used, the transition time of signal B′ picked up by coil 17 will be about 100 $\mu$s, which will provide an absolute precision in the reference time received of the order of 1 $\mu$s. To obtain a relative precision of $2.10^{-5}$ (about 2 sec per day), it will thus be necessary to use a reference time of 50 ms.

If these values are applied to the specific circuits of FIG. 15, H will be 320 Hz, i.e. just at the lower limit of the pass-band of the telephone system.

To obtain a relative precision of $10^{-6}$ ( ~1/10 sec per day), it would be necessary to have a reference time of 1 sec, which would give a frequency of 16 Hz for the clock signal H in the example of FIG. 15. However, this low frequency cannot be transmitted by the telephone system.

It would thus be necessary to choose a clock signal H or higher frequency and modify the counter 66 to 70 and the combinational circuit 73 to 76 in consequence (it is not in principle necessary to simultaneously modify the codes of the beginning and end of the reference time, nor the unti 2 which is incorporated in the watch).

Figure 17:
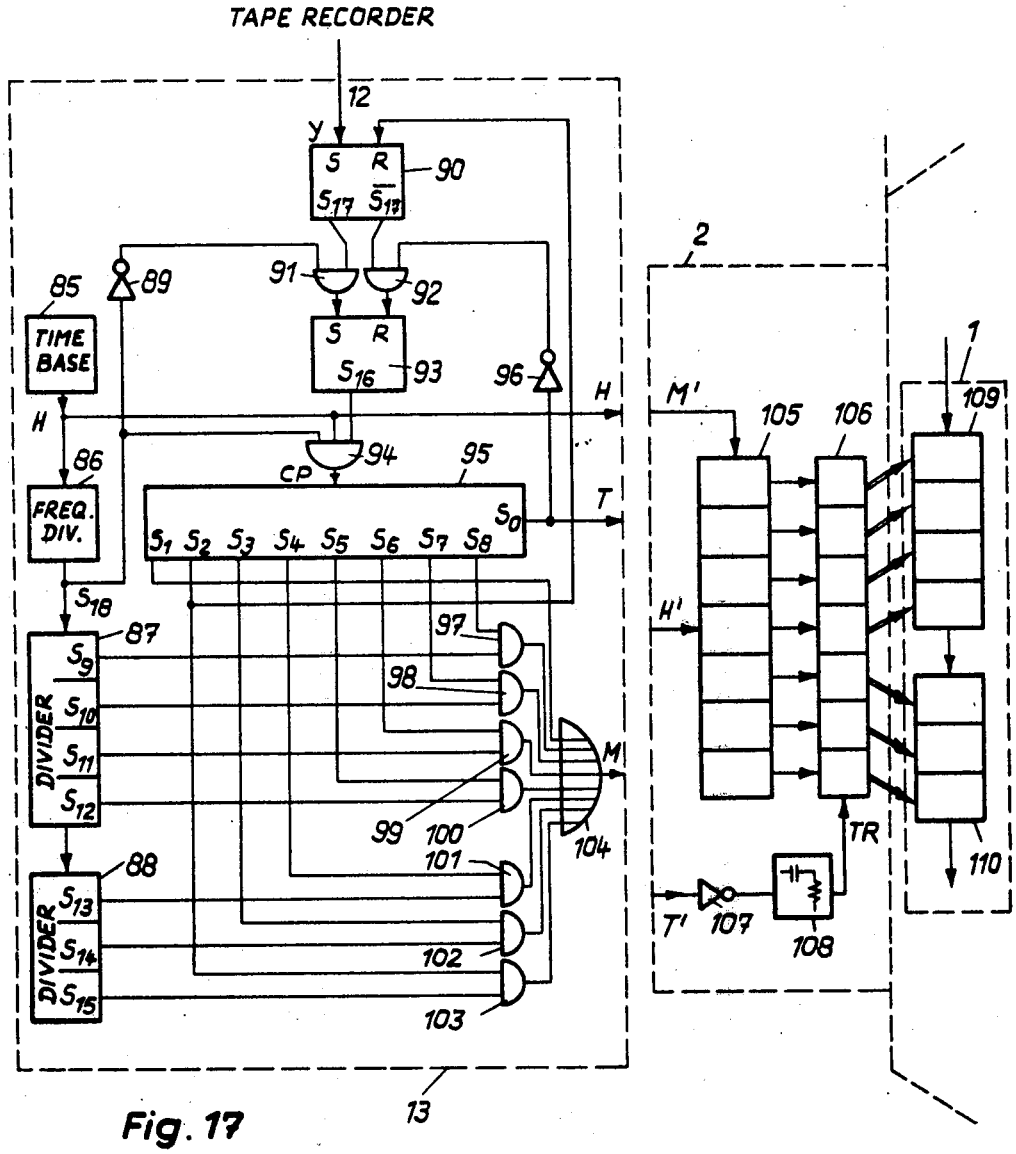
FIG. 17 shows an example of the signal generating and automatic regulation circuits of FIG. 1 permitting an automatic setting of the time.

FIG. 17 is the diagram of an example of units 13 and 2 which enables an automatic setting of the time displayed by a watch with an electronic display by means of the system of FIG. 1. In this case, signal M will be a signal relative to setting the time of the watch.

It is known that a watch with an electronic display comprises electronic counters for the seconds, minutes, hours and optionally the date. Setting of the time (and date) of such a watch involves setting the state of these counters. For the sake of simplification, in the example of FIG. 17, only setting of the seconds is considered. The same principle can however be employed in an analogous manner to the setting of minutes, hours, days, weeks, months and years.

Unit 13 of FIG. 17 comprises a time base 85 supplying clock signal H. This signal controls a chain of frequency dividers 86, 87 and 88; divider 86 supplies "seconds" signal $S_{18}$. Divider 87 (which counts the units of seconds) includes four cells supplying four signals $S_9$ to $S_{12}$. Divider 88 (which counts the tens of seconds) includes three cells supplying three signals $S_{13}$ to $S_{15}$. The unit 85 to 88 forms an electronic clock without a display; the second is contained in coded form in signals $S_9$ to $S_{15}$. The connection 12 from the tape recorder acts on the set input S of RS flip-flop 90. The output $S_{17}$ of 90 is combined with the reciprocal of $S_{18}$ in AND gate 91 to control the set input S of RS flip-flop 93. Output $S_{16}$ of 93 is combined with H and $S_{18}$ in AND gate 94 to form the control signal CP of a counter-decoder 95. A first output $S_0$ of 95 supplies signal T; the reciprocal of T is combined with $\overline{S_{17}}$ in AND gate 92 to control the reset input R of 93. A second output $S_1$ of 95 is directly supplied to an input of OR gate 104. The seven other outputs $S_2$ to $S_8$ of 95 are combined with respective signals $S_9$ to $S_{15}$ in respective AND gates 97 to 103 whose outputs are combined in OR gate 104 to form signal M. The output $S_2$ of 95 is also connected to reset input R of 90.

Unit 2 comprises a seven-cell shift register 105 receiving as clock signal H′ and as input the reconstituted message M′. A seven-cell transfer unit 106 is placed between register 105 and counters 109 and 110 which form part of watch 1. Four-cell counter 109 counts the units of seconds; three-cell counter 110 counts the tens of seconds.

Figure 19:
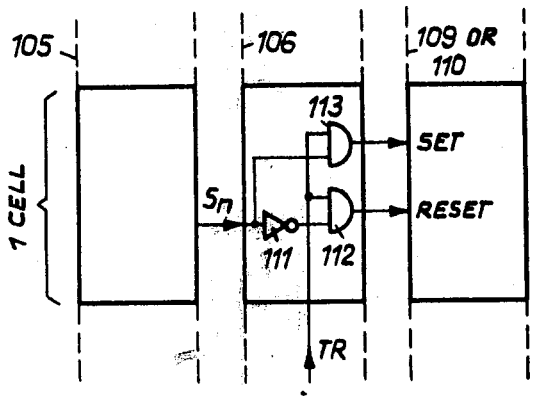
FIG. 19 shows details of a cell of a transfer circuit.

FIG. 19 shows a detail of a cell of transfer unit 106.

Signal $S_n$ from the corresponding cell of 105 is combined with transfer signal TR in AND gate 113 to form the set signal of the corresponding cell of 109 (or 110). The reciprocal of signal $S_n$ provided by inverter 111 is combined with TR in AND gate 112 to form the corresponding reset pulse.

Transfer signal TR is obtained by differentiating the reciprocal $\overline{T'}$ of T′ obtained in inverter 107 by means of unit 108.

Figure 18:
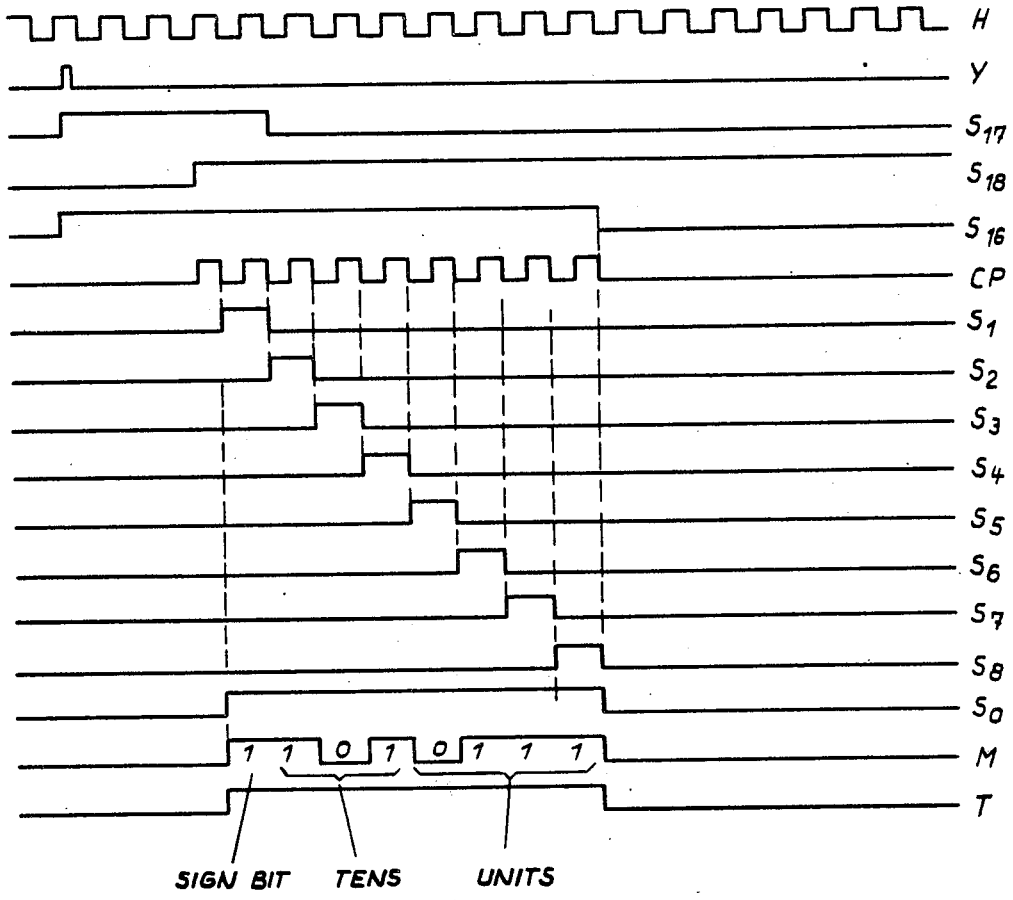
FIG. 18 is a diagram of the signals of the circuits of FIG. 17.

Operation is as follows (see the signals in FIG. 18):

The electronic clock 85 to 88 operates in an entirely conventional manner; this forms the time setting reference. In the example of FIG. 18, it is supposed that the frequency of H is 32 Hz. To supply seconds signal $S_{18}$, the division ratio of 86 is thus thirty-two.

When tape recorder 11 delivers triggering pulse Y, the output $S_{17}$ of 90 passes to 1. $S_{16}$ then passes to 1 as soon as $S_{18}$ is at 0. As soon as $S_{18}$ returns to 1, gate 94 opens and CP follows clock signal H. Unit 95 begins to count. Signal $S_0$ passes to 1 and signals $S_1$ to $S_8$ successively pass to 1 during respective periods of clock signal H. Passage of $S_2$ to 1 resets $S_{17}$ to 0. When $S_8$ returns to 0, $S_0$ also passes to 0, causing $S_{16}$ to drop to 0. Gate 94 closes and unit 95 stops counting until the next cycle triggered by a pulse Y.

By means of gates 97 to 104, the successive pulses of $S_1$ to $S_8$ produce successive appearance of firstly a 1, then the respective values of $S_9$ to $S_{15}$ as output signal M. The eight-bit message M is thus formed of a 1 (sign bit) and a succession of 0's and 1's corresponding to the state of counter 87 and 88, i.e. to the seconds and tens of seconds representing the exact time. In the example, the message 1 1 0 1 0 1 1 1 corresponds to 57 seconds in binary code.

Upon reception in unit 2, the corresponding message M′ is delivered to shift register 105; the first bit 1 disappears and is no longer used. At the end of the message, when T′ returns to 0, the pulse TR controls transfer of the seven significant bits into counters 109 and 110. Their contents are thus made equal to those of the respective counters 87 and 88, which signifies that the watch 1 is set to display the correct time.

The message used for regulation will in general contain the data required for both setting of the running and setting of the time of the electronic watch during the same telephone communication. the combination of these two regulating functions of a watch will be apparent to persons skilled in the art from the examples given.

What is claimed is:

1. A process for automatically regulating an electronic watch of the type comprising a time base, memory circuits, and display means coupled to said time base and said memory circuits, comprising composing on a telephone set in a telephone system the call code of an automatic telephone reply apparatus to which is connected a device supplying data necessary for the regulation at any time of the watch, and placing the watch so that coded signals transmitted by the reply apparatus control the state of said memory circuits of the watch to automatically set the latter.

2. A process according to claim 1, comprising indicating automatically to the user by means of a spoken message recorded in a tape recorder the operations to be carried out and the end of regulation.

3. A process according to claim 1, in which the telephone set and the electronic watch are coupled magnetically by leakage flux of the transformer of the set.

4. A process according to claim 1, in which the telephone set and the electronic watch are coupled acoustically.

5. A process according to claim 1, comprising generating data necessary for regualtion by means of a signal generator.

6. An automatically-regulatable electronic watch comprising a time base, memory circuits, display means coupled to said time base and said memory circuits, means for receiving coded regulation signals emitted by a telephone set, and means coupled to said receiver means and to said memory circuits for automatically controlling the state of said memory circuits as a function of said signals to set the watch.

7. A watch according to claim 6, in which said receiving means includes a pick-up coil responsive to magnetic coupling with a telephone set.

8. A watch according to claim 6, in which said receiving means includes an element responsive to acoustic coupling with a telephone set.

9. In an autonomous electronic watch comprising means for regulating the watch in response to a regulating signal, the improvement comprising means incorporated in the watch for directly receiving coded regulation signals emitted by a telephone set, and control means connecting said receiving means to said regulating means to automatically regulate the watch in response to reception of a said coded signal from a telephone set.

* * * * *